United States Patent [19]

Hibino et al.

[11] Patent Number: 4,730,594

[45] Date of Patent: Mar. 15, 1988

[54] AIR FUEL RATIO CONTROL SYSTEM FOR AN INTERNAL COMBUSTION ENGINE WITH AN IMPROVED OPEN LOOP MODE OPERATION

[75] Inventors: Yoshitaka Hibino; Takeshi Fukuzawa, both of Wako, Japan

[73] Assignee: Honda Giken Kogyo Kabushiki Kaisha, Tokyo, Japan

[21] Appl. No.: 915,470

[22] Filed: Oct. 6, 1986

[30] Foreign Application Priority Data

Oct. 5, 1985 [JP] Japan ..... 60-222172

[51] Int. Cl.[4] ..... F02M 23/08; F02M 23/10

[52] U.S. Cl. ..... 123/589; 123/486; 123/489

[58] Field of Search ..... 123/436, 440, 478, 486, 123/488, 489, 585, 588, 587, 589

[56] References Cited

U.S. PATENT DOCUMENTS 4,309,971 1/1982 Chiesa et al. ..... 123/486 X
4,466,411 8/1984 Hasegawa et al. ..... 123/489 X
4,562,814 1/1986 Abo et al. ..... 123/486 X
4,570,599 2/1986 Hasegawa et al. ..... 123/489
4,592,325 6/1986 Nakagawa ..... 123/489
4,640,254 2/1987 Ninomiya ..... 123/486 X

*Primary Examiner*—Willis R. Wolfe, Jr.
*Attorney, Agent, or Firm*—Pollock, VandeSande & Priddy

[57] ABSTRACT

An air/fuel ratio control system is constructed to calculate a base value of an air/fuel ratio control in response to a plurality of engine operational parameters. The base value is adjusted by an output signal of an exhaust gas component concentration sensor, to provide an output value which is directly used for the air/fuel ratio control. Under a predetermined operational condition of the engine, the adjustment of the base value on the basis of the output signal of the exhaust gas component concentration sensor is stopped and the base value is corrected by a correction value, which is one of a number of values stored correspondingly as engine operational parameters, and read out using present values of the engine operational parameters.

3 Claims, 9 Drawing Figures

| FIG. 4A |
| --- |
| FIG. 4B |

AIR FUEL RATIO CONTROL SYSTEM FOR AN INTERNAL COMBUSTION ENGINE WITH AN IMPROVED OPEN LOOP MODE OPERATION

BACKGROUND OF THE INVENTION

1. Field of the Invention

The present invention relates to an air/fuel ratio control system for an internal combustion engine, and more particularly a system in which an air/fuel ratio of mixture to be supplied to the engine is controlled basically in response to an output signal level of an oxygen concentration sensor.

2. Description of Background Information

Air/fuel ratio feedback control systems for an internal combustion engine are known as systems in which oxygen concentration in the exhaust gas of the engine is detected by an oxygen concentration sensor (referred to as $O_2$ sensor hereinafter) and an air/fuel ratio of mixture to be supplied to the engine is feedback controlled in response to an output signal level of the $O_2$ sensor for the purification of the exhaust gas and improvements of the fuel economy.

In this type of air/fuel ratio control system, a base value of the air/fuel ratio control is set in response to a plurality of engine parameters relating to the engine load, and the base value is corrected cyclically in response to the output signal level of the $O_2$ sensor for elapse of a predetermined time period.

The feedback control of the air/fuel ratio in response to the output signal level of the $O_2$ sensor is stopped under engine operational conditions such as a low load engine operation. During the stoppage of the feedback control of the air/fuel ratio, the air/fuel ratio of the mixture supplied to the engine is controlled to a rich air/fuel ratio value or a lean air/fuel ratio value. For this purpose, an opening degree of a solenoid valve provided for regulating the air/fuel ratio is controlled in accordance with a control value obtained by a multiplication between the previously set base value and an enrichment coefficient or a leaning coefficient. However, it is difficult to avoid the difference between the target air/fuel ratio and an actual air/fuel ratio of mixture because of various reasons such as the age-induced change in the detection characteristic of sensors for detecting the engine operational parameters, or the deterioration of the $O_2$ sensor. Therefore, if, for example, the air/fuel ratio is controlled to the lean side to reduce the fuel consumption when the engine load is low, the air/fuel ratio of the mixture may not be precisely controlled to the desired value, causing an adverse effect on the driveability.

OBJECTS AND SUMMARY OF THE INVENTION

An object of the present invention is to provide an air/fuel ratio control system by which adequate driveability is assured during the stoppage of the feedback control of the air/fuel ratio even though time-induced change or the deterioration has occurred for any of the engine operation sensors.

According to the present invention, an air/fuel ratio control system is constructed to set a base value for adjusting the air/fuel ratio in response to a plurality of engine operational parameters relating to the load of the internal combustion engine. The base value is corrected in response to an exhaust gas component concentration so as to provide an output value by which the air/fuel ratio is adjusted. A correction value for correcting an error of the base value is calculated every time for the determination of the output value. The calculated correction value is stored in relation to each value of the plurality of engine parameters. During predetermined operating conditions of the engine, the correction of the base value in response to the exhaust gas component concentration is stopped and the base value is corrected by a correction value responsive to present values of the plurality of the engine operational parameters. The thus obtained corrected value is then used to determine the air/fuel ratio of the mixture supplied to the engine.

BRIEF DESCRIPTION OF THE DRAWINGS

FIGS. 3A, 3B, 4A and 4B, when combined respectively, are flowcharts showing the manner of operation of a CPU 29 in the control circuit 20 in a first embodiment of the air/fuel ratio control system according to the present invention;

FIGS. 3 and 4 are diagrams showing juxtaposition of FIGS. 3A and 3B, FIGS. 4A and 4B respectively;

DETAILED DESCRIPTION OF THE PREFERRED EMBODIMENT

Referring to the accompanying drawings, the embodiment of the air/fuel ratio control system of the air intake side secondary air supply control type according to the present invention will be explained hereinafter.

Figure 1:
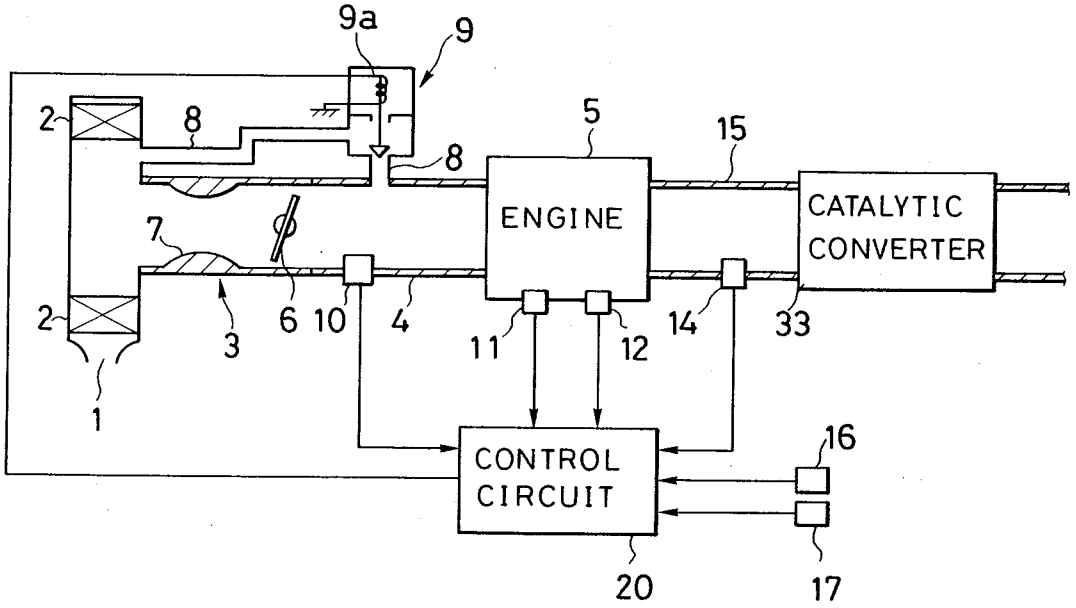
FIG. 1 is a schematic diagram showing a general construction of the air/fuel ratio control system according to the invention.

In FIG. 1 which illustrates a general construction of the air/fuel ratio control system, an intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. An inside of the air cleaner 2, near an air outlet port, communicates with the intake manifold 4 via an air intake side secondary air supply passage 8. The air intake side secondary air supply passage 8 is provided with a linear type solenoid valve 9. The opening degree of the solenoid valve 9 is varied according to the magnitude of a drive current supplied to a solenoid 9*a* thereof.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, and an $O_2$ sensor 14 which is provided in an exhaust manifold 15 of the engine for generating an output signal whose level varies in proportion to an oxygen concentration in the exhaust gas. Further, a catalytic converter 33 for accelerating the reduction of the noxious components in the exhaust gas is provided in the exhaust manifold 15 at a location on the downstream side of the position of the $O_2$ sensor 14. The linear type solenoid valve 9, the absolute pressure sensor 10, the crank angle sensor 11, the engine cooling water temperature sensor 12, and the $O_2$ sensor 14 are electrically connected to a control circuit 20. Further, a vehicle speed sensor 16 which produces an output signal whose level is proportional to the speed of the vehicle and an atmospheric pressure sensor 17 are electrically connected to the control circuit 20.

Figure 2:
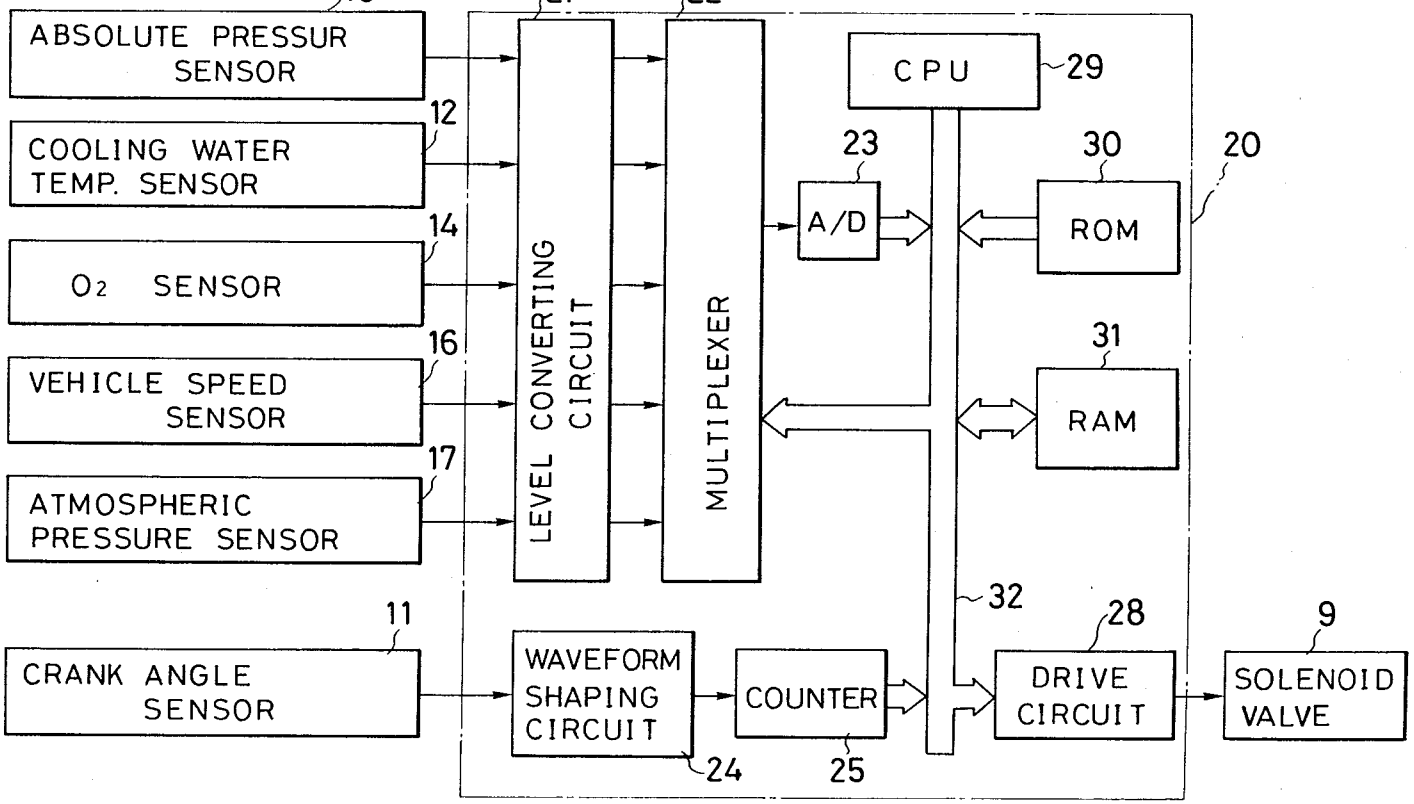
FIG. 2 is a block diagram showing the concrete construction of the control circuit 20 of the system of FIG. 1.
Figure 3A:
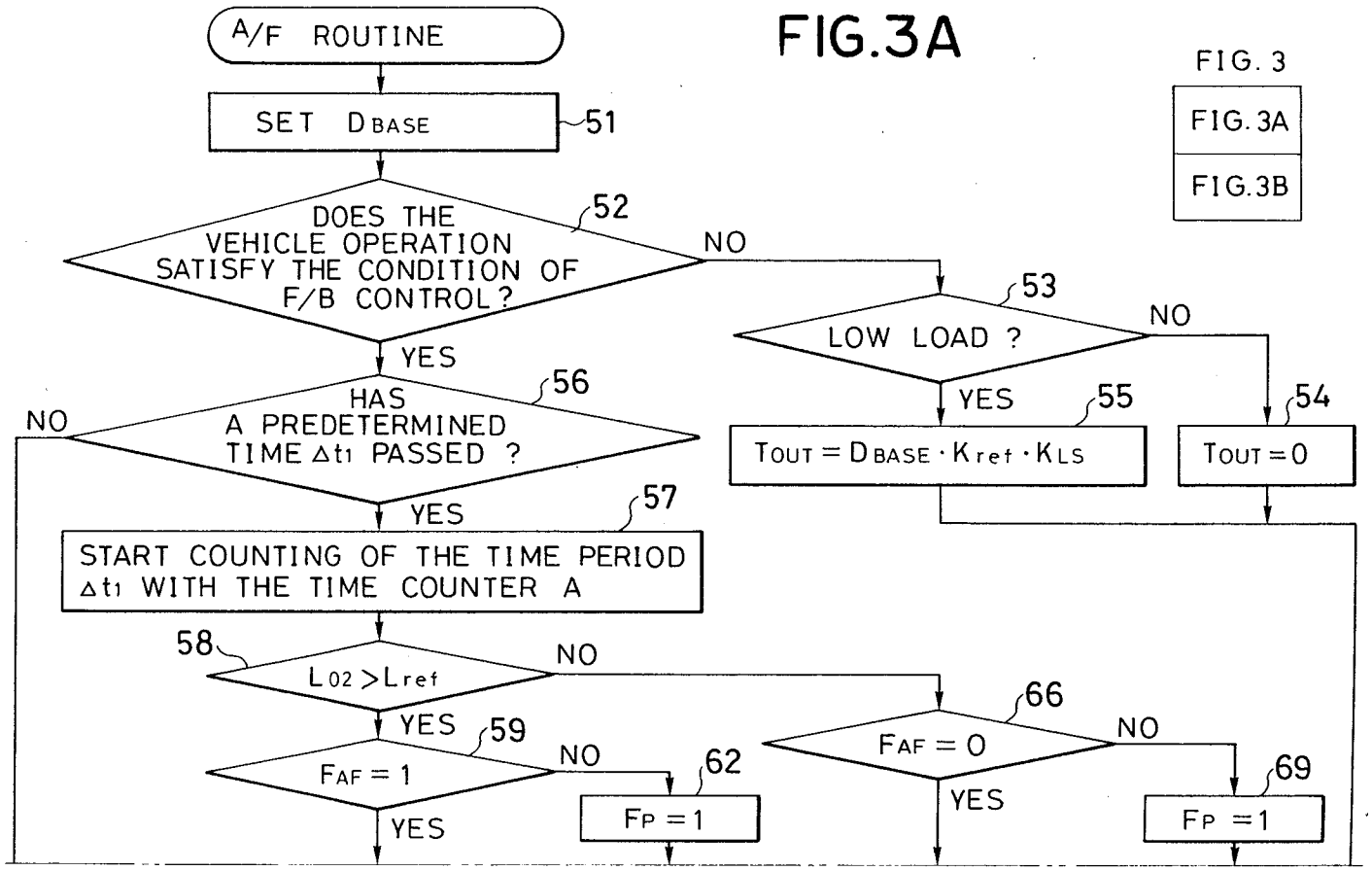
Figure 3B:
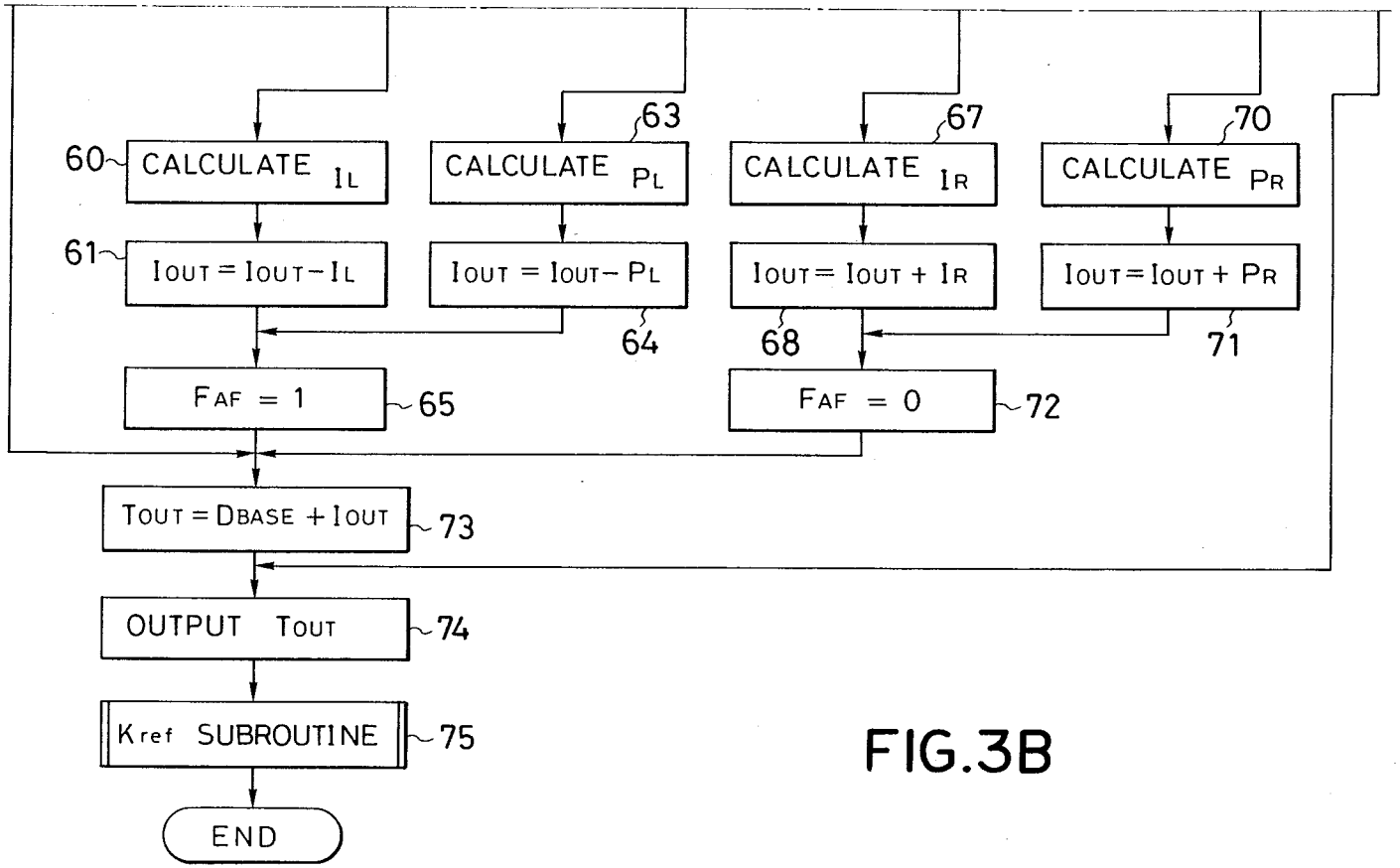

FIG. 2 shows the construction of the control circuit 20. As shown, the control circuit 20 includes a level converting circuit 21 which performs the level conversion of the output signals of the absolute pressure sensor 10, the engine cooling water temperature sensor 12, the $O_2$ sensor 14, the vehicle speed sensor 16, and the atmospheric pressure sensor 17. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which performs a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28 for driving the solenoid valve 9 in an opening direction, a CPU (central processing unit) 29 which performs digital operations according to various programs, and a ROM 30 in which various operating programs and data are previously stored, and a RAM 31. The solenoid 9a of the solenoid valve 9 is connected in series with a drive transistor and a current detection resistor, both not shown, of the drive circuit 28. The multiplexer 22, the A/D converter 23, the counter 25, the drive circuit 28, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed, is selectively supplied from the A/D converter 23 to the CPU 29 via the input/output bus 32. Also information indicative of the engine speed from the counter 25 is supplied to the CPU 29 via the input/output bus 32. The CPU 29 is constructed to generate an internal interruption signal every one cycle of a predetermined period $T_1$ (100 m sec, for instance). In response to this internal interruption signal, the CPU 29 calculates an output value $T_{OUT}$ indicative of the magnitude of the current to the solenoid 9a of the solenoid valve 9, in the form of data. The output value $T_{OUT}$ is in turn supplied to the drive circuit 28. The drive circuit 28 performs a closed loop control of the magnitude of the current flowing through the solenoid 9a so that it is controlled to a value corresponding to the output value $T_{OUT}$.

Referring to the flowcharts of FIGS. 3A and 3B, 4A and 4B, the operation of the air/fuel ratio control system of the air intake side secondary air supply type according to the present invention will be explained hereinafter.

Figure 5:
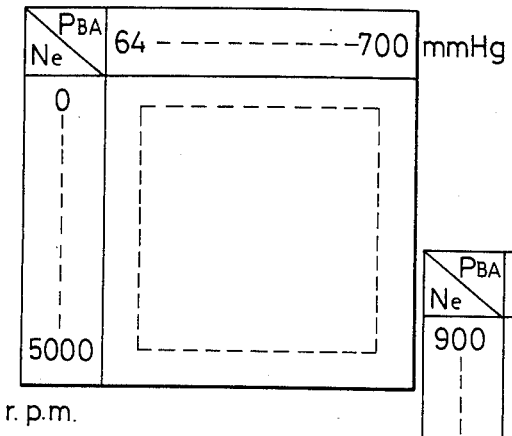
FIG. 5 is a diagram showing a $D_{BASE}$ data map which is previously stored in a ROM 30 of the control circuit 20.
Figure 6:
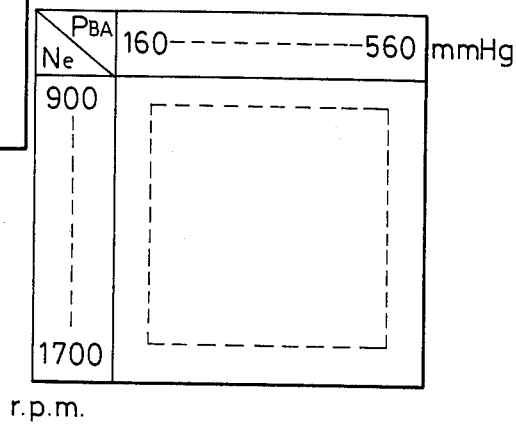
FIG. 6 is a diagram showing a $K_{ref}$ data map stored in a RAM 31 of the control circuit.

At a step 51, a base value $D_{BASE}$ indicative of the base value of the current to the solenoid valve 9 is set in the CPU 29 and supplied to the drive circuit 28, every time an internal interruption signal is generated in the CPU 29. Various values of the base value $D_{BASE}$ which are determined according to the absolute pressure within the intake manifold $P_{BA}$ and the engine speed $N_e$ are previously stored in the ROM 30 in the form of a $D_{BASE}$ data map as shown in FIG. 5, and the CPU 29 at first reads present values of the absolute pressure $P_{BA}$ and the engine speed $N_e$ and in turn searches a value of the base value $D_{BASE}$ corresponding to the read values from the $D_{BASE}$ data map in the ROM 30. After the set of the base value $D_{BASE}$, whether or not the operating state of the vehicle satisfies a condition for the feedback (F/B) control is detected at a step 52. This detection is performed according to various parameters, i.e., absolute pressure within the intake manifold, engine cooling water temperature, vehicle speed, and engine rotational speed. For instance, when the vehicle speed is low, or when the engine cooling water temperature is low, it indicates that the condition for the feedback control is not satisfied. If it is determined that the condition for the feedback control is not satisfied, whether or not the engine load is low is detected at a step 53. This detection is performed, for example, by means of the absolute pressure $P_{BA}$. If the absolute pressure $P_{BA}$ is larger than 200 mmHg and smaller than 400 mmHg, it is determined that the engine is operating under the low load condition. If the engine is not operating under the low load condition, the output value $T_{OUT}$ is made equal to "0" at a step 54 so that the feedback control is stopped. If, on the other hand, the engine is operating under the low load condition, the output value $T_{OUT}$ is calculated by using an equation: $T_{OUT}=D_{BASE}\cdot K_{ref}\cdot K_{LS}$, at a step 55. In this equation, $K_{ref}$ is a correction value for compensating for an error of the base value $D_{BASE}$ set at the step 51, and $K_{LS}$ is a leaning coefficient (for example, 1.2). In the RAM 31, as shown in FIG. 6, various values of the correction value $K_{ref}$ which are determined by the absolute pressure $P_{BA}$ in the intake manifold and the engine rotational speed Ne, are previously stored in the form of a $K_{ref}$ data map. Therefore, the CPU 29 searches a value of the correction value $K_{ref}$ from the $K_{ref}$ data map using present values of the absolute pressure PBA and the engine rotational speed Ne, for the calculation of the output value $T_{OUT}$. In addition, the RAM 31 is of the non-volatile type, and the memorized contents are maintained also when the engine 5 is stopped. Initial setting of the values of the $K_{ref}$ data map is performed before the initial using of this system.

On the other hand, if it is determined that the condition for the feedback control is satisfied, whether or not a count period of a time counter A incorporated in the CPU 29 (not shown) has reached a predetermined time period $\Delta t_1$ is detected at a step 56. This predetermined time period $\Delta t_1$ corresponds to a delay time from a time of the supply of the air intake side secondary air to a time in which a result of the supply of the air intake side secondary air is detected by the $O_2$ sensor 14 as a change in the oxygen concentration of the exhaust gas. When the predetermined time period $\Delta t_1$ has passed after the time counter A is reset to start the counting of time, the counter is reset again, at a step 57, to start the counting of time from a predetermined initial value. In other words, a detection as to whether or not the predetermined time period $\Delta T_1$ has passed after the start of the counting of time from the initial value by the time counter A, i.e. the execution of the step 57, is performed at the step 56. After the start of the counting of the predetermined time period $\Delta t_1$ by the time counter A in this way, whether or not the output signal level of the $O_2$ sensor 14 is greater than the reference value Lref which corresponds to a target air/fuel ratio is detected at a step 58. In other words, whether or not the air/fuel ratio of mixture is leaner than the target air/fuel ratio is detected at the step 58. If $LO_2 > Lref$, it means that the air/fuel ratio of the mixture is leaner than the target air/fuel ratio, whether or not an air/fuel ratio flag $F_{AF}$ which indicates a result of a previous cycle of detection by the step 58 is equal to "1" is detected at a step 59. If $F_{AF}=1$, it means that the air/fuel ratio was detected to be lean in a previous detection cycle. Then, a subtraction value $I_L$ is calculated at a step 60. The subtraction value $I_L$ is obtained by multiplication among a constant $K_1$, the engine speed $N_e$, and the absolute pressure $P_{BA}$, $(K_1 \cdot N_e \cdot P_{BA})$, and is dependent on the amount of the intake air of the engine 5. After the calculation of the subtraction value $I_L$, a correction value $I_{OUT}$ which is previously calculated by the execution of operations of the A/F routine is read out from a memory location $a_1$ in the RAM 31. Subsequently, the subtraction value $I_L$ is subtracted from the correction value $I_{OUT}$, and a result is in turn written in the memory location $a_1$ of the RAM 31 as a new correction value $I_{OUT}$, at a step 61. On the other hand, if $F_{AF}=0$, it means that the air/fuel ratio was detected to be rich in the previous detection cycle and the air/fuel ratio has turned lean from the rich state. Therefore, a value "1" is set to a flag $F_P$ indicating the change in the direction of the air/fuel ratio control at a step 62, and a subtraction value $P_L$ is calculated at a step 63. The subtraction value $P_L$ is obtained by a multiplication between the subtraction value $I_L$ and a constant $K_3 (K_3 > 1)$. After the calculation of the subtraction value $P_L (K_3 \cdot I_L)$, the correction value $I_{OUT}$ which is previously calculated by the execution of operations of the A/F routine is read out from the memory location $a_1$ in the RAM 31. Subsequently, the subtraction value $P_L$ is subtracted from the correction value $I_{OUT}$, and a result is in turn written in the memory location $a_1$ of the RAM 31 as a new correction value $I_{OUT}$, at a step 64. After the calculation of the correction value $I_{OUT}$ at the step 61 or the step 64, a value "1" is set for the flag $F_{AF}$, at a step 65, for indicating that the air/fuel ratio is lean. On the other hand if $LO_2 \leqq Lref$ at the step 58, it means that the air/fuel ratio is richer than the target air/fuel ratio. Then, whether or not the air/fuel ratio flag $F_{AF}$ is "0" is detected at a step 66. IF $F_{AF}=0$, it means that the air/fuel ratio was detected to be rich in the previous detection cycle. Then, a summing value $I_R$ is calculated at a step 67. The summing value $I_R$ is calculated by a multiplication among a constant value $K_2$ $(\neq K_1)$, the engine speed $N_e$, and the absolute pressure $P_{BA}$ $(K_2 \cdot N_3 \cdot P_{BA})$, and is dependent on the amount of the intake air of the engine 5. After the calculation of the summing value $I_R$, the correction value $I_{OUT}$ which is previously calculated by the execution of the A/F routine is read out from the memory location $a_1$ of the RAM 31, and the summing value $I_R$ is added to the read out correction value $I_{OUT}$. A result of the summation is in turn stored in the memory location $a_1$ the RAM 31 as a new correction value $I_{OUT}$ at a step 68. If $F_{AF}=1$ at the step 66, it means that the air/fuel ratio was detected to be lean in the previous detection cycle, and the air/fuel ratio has turned rich from the lean condition. Then, a summing value $P_R$ is calculated at a step 70. The summing value $P_R$ is obtained by a multiplication between the summing value $I_R$ and a constant $K_4$ $(K_4 > 1)$. After the calculation of the summing value $P_R$ $(K_4 \cdot I_R)$, the correction value $I_{OUT}$ which is previously calculated by the execution of operations of the A/F routine is read out from the memory location $a_1$ in the RAM 31. Subsequently, the summing value $P_R$ is added to the correction value $I_{OUT}$, and a result is in turn written in the memory location $a_1$ of the RAM 31 as a new correction value $I_{OUT}$, at a step 71. After the calculation of the correction value $I_{OUT}$ at the step 68 or the step 71, a value "0" is set for the flag $F_{AF}$, at a step 72, for indicating that the air/fuel ratio is rich. After the calculation of the correction value $I_{OUT}$ at the step 61, 64, 68 or 71 in this way, the correction value $I_{OUT}$ and the base value $D_{BASE}$ set at the step 51 are added together, and a result of addition is made as an output value $T_{OUT}$ at a step 73. After the calculation of the output value $T_{OUT}$, the output value $T_{OUT}$ is output to the drive circuit 28 at a step 74. Subsequently, a $K_{ref}$ calculation subroutine is executed at a step 75.

Figure 7:
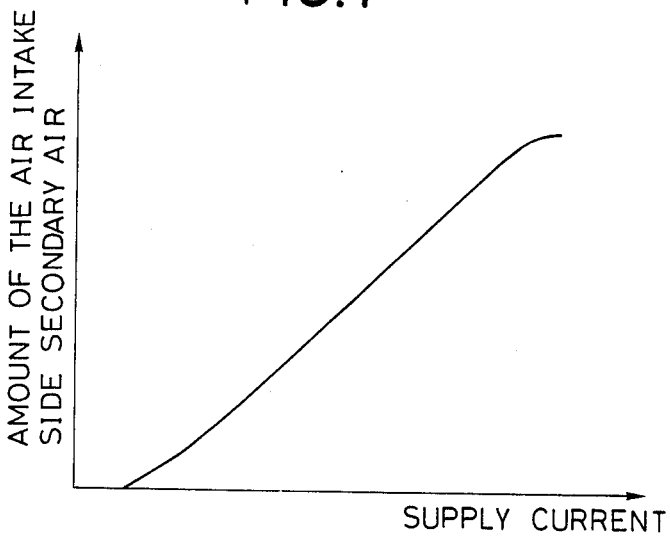
FIG. 7 is a diagram showing the relationship between the current value to the solenoid valve and the amount of the air intake side secondary air.

The drive circuit 28 is operative to detect the current flowing through the solenoid value 9a of the solenoid 9 by means of the resistor for detecting the current, and to compare the detected magnitude of the current with the output value $T_{OUT}$. In response to a result of the comparison, the drive transistor is on-off controlled to supply the drive current of the solenoid 9a. In this way, the current flowing through the solenoid 9a becomes equal to a value represented by the output value $T_{OUT}$. Therefore, as shown in FIG. 7, the air intake side secondary air whose amount is proportional to the magnitude of the current flowing through the solenoid 9a of the solenoid valve 9 is supplied into the intake manifold 4.

Additionally, after the reset of the time counter A and the start of the counting from the initial value at the step 57, if it is detected that the predetermined time period $\Delta t_1$ has not yet passed, at the step 56, the operation of the step 73 is immediately executed. In this case, the correction value $I_{OUT}$ calculated by the A/F routine up to the previous cycle is read out.

Figures 4, 4A:
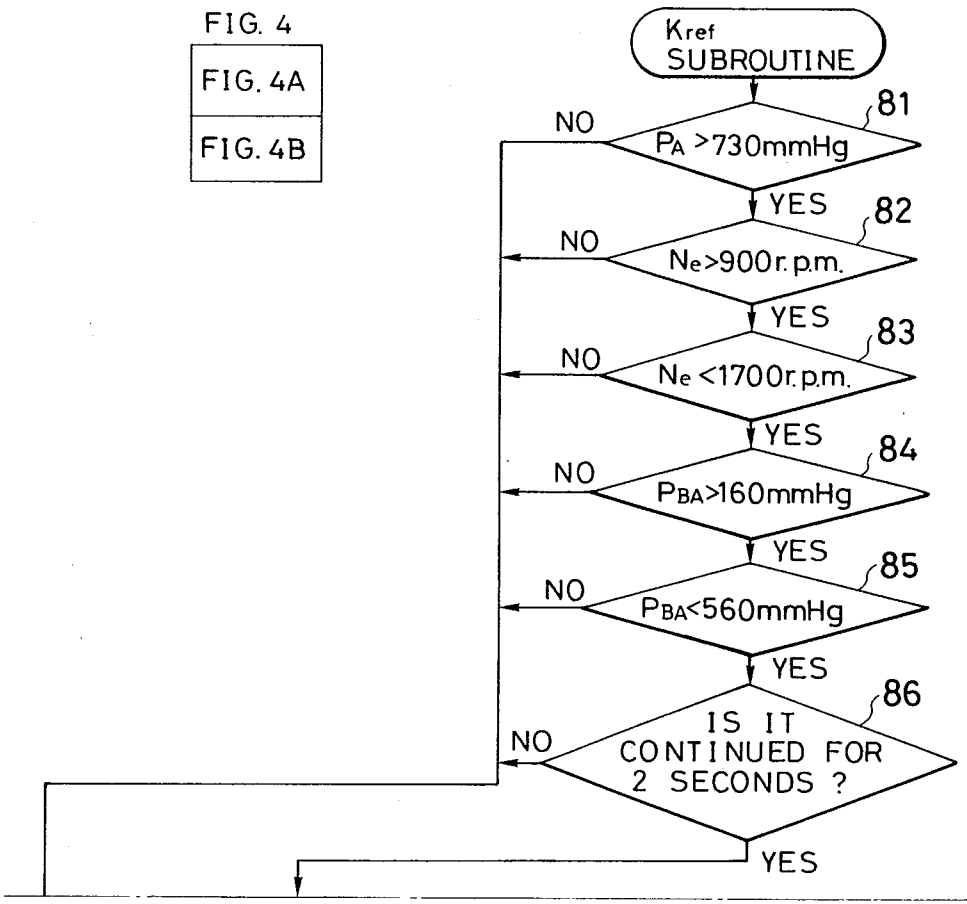
Figure 4B:
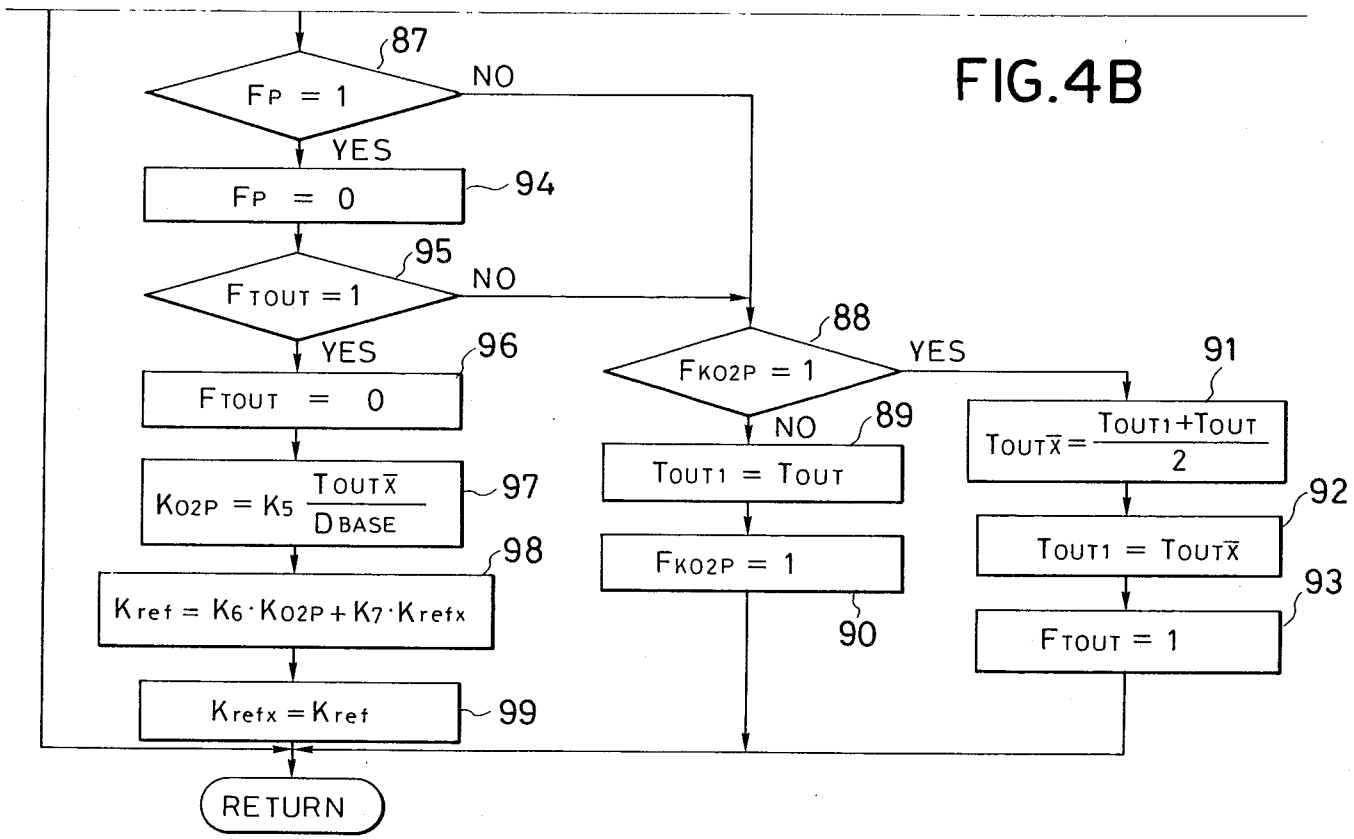

As shown in FIGS. 4A and 4B, in the $K_{ref}$ calculation subroutine, whether or not the atmospheric pressure $P_A$ is higher than 730 mmHg is detected at a step 81. If $P_A > 730$ mmHg, whether or not the engine speed Ne is higher than 900 r.p.m. and lower than 1700 r.p.m. is detected at steps 82 and 83 respectively. If 1700 r.p.m. $> Ne > 900$ r.p.m., whether or not the absolute value of the intake air $P_{BA}$ is higher than 160 mmHg and lower than 560 mmHg, is detected at steps 84 and 85 respectively. If 160 mmHg $< P_{BA} <$ 560 mmHg, it is considered that the engine is operating under a steady state, and whether or not this steady state has continued for more than 2 seconds is detected at a step 86. If the engine operation under the steady state has continued for more than 2 seconds, whether or not the flag $F_P$ is equal to 1 is detected at a step 87. If $F_P=0$, whether or not a flag $F_{KO2P}$ is equal to "1" is detected at a step 88. The flag $F_{KO2P}$ is provided for indicating that the operation of the step 88 is executed for the first time in this subroutine, and initially set to "0" upon application of the power current. If $F_{KO2P}=0$, the output value $T_{OUT}$ calculated by the execution of the A/F routine of the present time is maintained as a preceding average value $T_{OUT1}$, at a step 89. At the same time, a value "1" is set for the flag $F_{KO2P}$ at a step 90. If $F_{KO2P}=1$, it means that the operation of the step 90 has been executed, and the output value $T_{OUT}$ calculated by the A/F routine of the present time and the preceding average value $T_{OUT1}$ are added together, and then divided by 2 so as to produce an average value $T_{OUT\bar{X}}$ of the output value $T_{OUT}$ at a step 91. The average value $T_{OUT\bar{X}}$ is maintained as the preceding average value $T_{OUT1}$ at a step 92. At the same time, a value "1" is set for a flag $F_{TOUT}$ which indicates that the average value $T_{OUT\bar{X}}$ of the output value $T_{OUT}$ is calculated, at a step 93.

On the other hand, if it is detected that $F_P=1$ at the step 87, it means that the direction of the air/fuel ratio control has changed, and "0" is set for the flag $F_P$ at a step 94. At the same time, whether or not the flag $F_{TOUT}$ is equal to "1" is detected at a step 95. If $F_{TOUT}=0$, it means that the average value $T_{OUT\bar{X}}$ is not yet calculated, and the operation of the step 88 is executed. If $F_{TOUT}=1$, it means that the average value $T_{OUT\bar{X}}$ is already calculated by the operation of the step 91, "0" is set for the flag $F_{TOUT}$ at a step 96. At the same time, by using an equation $K_{O2P}=K_5 \cdot T_{OUT\bar{X}}/D_{BASE}$, a value $K_{O2P}$ indicative of the error of the base value $D_{BASE}$ is calculated at a step 97. In this equation, $K_5$ is a constant. Then, by using an equation $K_{ref}=K_6 \cdot K_{O2P}+K_7 \cdot K_{refx}$, a correction value $K_{ref}$ correcting the error of the base value $D_{BASE}$ is calculated, and stored in a position in the $K_{ref}$ data map of the RAM 31, corresponding to the present values of the absolute pressure $P_{BA}$ in the intake manifold and the engine speed Ne, at a step 98. In this equation, $K_6$ and $K_7$ are constants, and $K_{refx}$ is a correction value obtained by the execution of the operation of the step 98 in the previous cycle. After the calculation of the correction value $K_{ref}$, the calculated correction value $K_{ref}$ is set as the preceding correction value $K_{refx}$ at a step 99. By repeating the operations of this subroutine, the correction value $K_{ref}$ in the $K_{ref}$ data map is altered to a new value in response to the time-induced change or the deterioration of the sensors.

In the above explained embodiment, the flags $F_P$ and $F_{TOUT}$ are initialized to "0" upon application of the power current. When it is detected that $F_P=0$ at the step 87, i.e. at the time of execution of this subroutine subsequent to the operation of the step 94 after the change in the direction of the air/fuel ratio control, or when it is detected that $F_{TOUT}=0$ at the step 95, i.e. the execution of this subroutine subsequent to the operation of the step 95 after the calculation of the average value $T_{OUTX}$, the operation of the step 88 will be executed.

Above, the present invention has been described by way of an example in which the air/fuel ratio control is performed by adjusting the amount of the air intake side secondary air. However, it is to be noted that the present invention is applicable to an air/fuel ratio control system for an internal combustion engine of fuel injection type in which a fuel injector or injectors are utilized. In such a case, a base fuel injection time which can be also expressed as $D_{BASE}$ is corrected by means of the correction value $K_{ref}$ under operational condition of the engine where the feedback control of the air/fuel ratio is stopped. For instance, when the engine load is low, an output value $T_{OUT}$ of the fuel injection time is calculated by using the equation $T_{OUT}=D_{BASE} \cdot K_{ref} \cdot K_{LS}$. When the engine load is high, the output value $T_{OUT}$ is calculated by using the equation $T_{OUT}=D_{BASE} \cdot K_{ref} \cdot K_{WOT}$. The leaning coefficient $K_{LS}$ in this case is, for example, 0.8, and the enrichment coefficient $K_{WOT}$ is 1.2.

Thus, in the air/fuel ratio control system according to the present invention, the error of the base value of the air/fuel ratio adjustment which is set according to a plurality of engine parameters is compensated. Correction values are calculated and each value of the correction values is stored in relation to a plurality of engine parameters. Therefore, when the feed back control of the air/fuel ratio is under a low load condition of the engine or if the base value which is to be used, to make lean or to enrich the air/fuel ratio with the control loop opened deviates from a desired value due to the time-induced change or the deterioration of the sensors, such an error of the base value can be compensated for by using the correction value. Thus, the output value for the air/fuel ratio control can be calculated properly, to assure adequate driveability.

What is claimed is:

1. In an air/fuel ratio control system for an internal combustion engine, the system including a plurality of sensors for sensing engine opertional parameters relating to an engine load, an exhaust gas sensor for sensing a concentration of an exhaust gas component of the internal combustion engine, and an air/fuel ratio controller for controlling an air/fuel ratio of a mixture supplied to the engine in response to an output value determined on the basis of signals from said sensors, the system comprising:

means connected to said plurality of of sensors for setting a base value of air/fuel ratio control in response to said engine parameters at intervals of a predetermined time period, the base value being obtained from a plurality of predetermined values stored in a first memory means comprising a read only memory;

means for adjusting said base value in response to a result of comparison between a target air/fuel ratio and a detected air/fuel ratio obtained by an output signal of said exhaust gas sensor to provide said output value;

means for calculating correction values to compensate for possible errors of said base value each time said output value is produced;

second memory means for storing each calculated value of said correction values in connection with each value of said plurality of engine operational parameters, said second memory means comprising a random access memory;

means for detecting a predetermined operational condition of said internal combustion engine; and means for stopping said adjustment of said base value in response to the output signal of said exhaust gas sensor when said predetermined operational condition is detected, and correcting said base value by a value chosen from said correction values stored in said second memory means to provide said output value, said chosen value corresponding to present values of said plurality of engine operational parameters, wherein said means together form a control unit of the air/fuel ratio.

2. A system as set forth in claim 1, wherein said secondary memory means for storing each calculated value comprise a data map in a memory in which calculated values of said correction values are respectively stored in memory locations corresponding to each value of said plurality of engine operational parameters.

3. A system as set forth in claim 1, wherein said means for calculating correction values is adapted to calculate said correction values when a steady state of engine operation has continued for more than a predetermined time period.

* * * * *